United States Patent [19]

Rhee

[11] 4,281,940

[45] Aug. 4, 1981

[54] LOOSE-LEAF BINDER

[76] Inventor: Gwang H. Rhee, 6700 Seville Ave., #909, Huntington Park, Calif. 90255

[21] Appl. No.: 64,727

[22] Filed: Aug. 8, 1979

[51] Int. Cl.[3] ..... B42F 13/22

[52] U.S. Cl. ..... 402/38; 402/73; 402/75; 402/76; 402/80 P

[58] Field of Search ..... 402/31, 38, 32, 33, 402/39, 73, 74, 75, 76, 77, 80 R, 80 P

[56] References Cited

U.S. PATENT DOCUMENTS

| | | | |
|---|---|---|---|
| 1,362,951 | 12/1920 | McBee | 402/76 |
| 2,528,866 | 11/1950 | Dawson, Jr. | 402/33 |
| 2,891,553 | 6/1959 | Acton | 402/33 |
| 3,252,461 | 5/1966 | Schade | 402/75 X |
| 3,944,374 | 3/1976 | Young et al. | 402/76 X |

FOREIGN PATENT DOCUMENTS

| | | | |
|---|---|---|---|
| 255369 | 7/1967 | Austria | 402/80 R |
| 2243715 | 4/1974 | Fed. Rep. of Germany | 402/32 |

*Primary Examiner*—Paul A. Bell

*Attorney, Agent, or Firm*—Vernon D. Beehler

[57] ABSTRACT

A loose-leaf binder makes use of a hinged back comprising parallel hinge leaves pivotally attached to each other at adjacent edges. There is an interlock at one end consisting of resilient flanges normally interlocked in overlying relationship, but releasable by tilting one flange away from the other. Rings which extend through the holes in sheets of paper may be individually mounted in a retention track so that they can be varied as to spacing and also varied as to the number of rings made use of.

13 Claims, 17 Drawing Figures

Fig. 1.
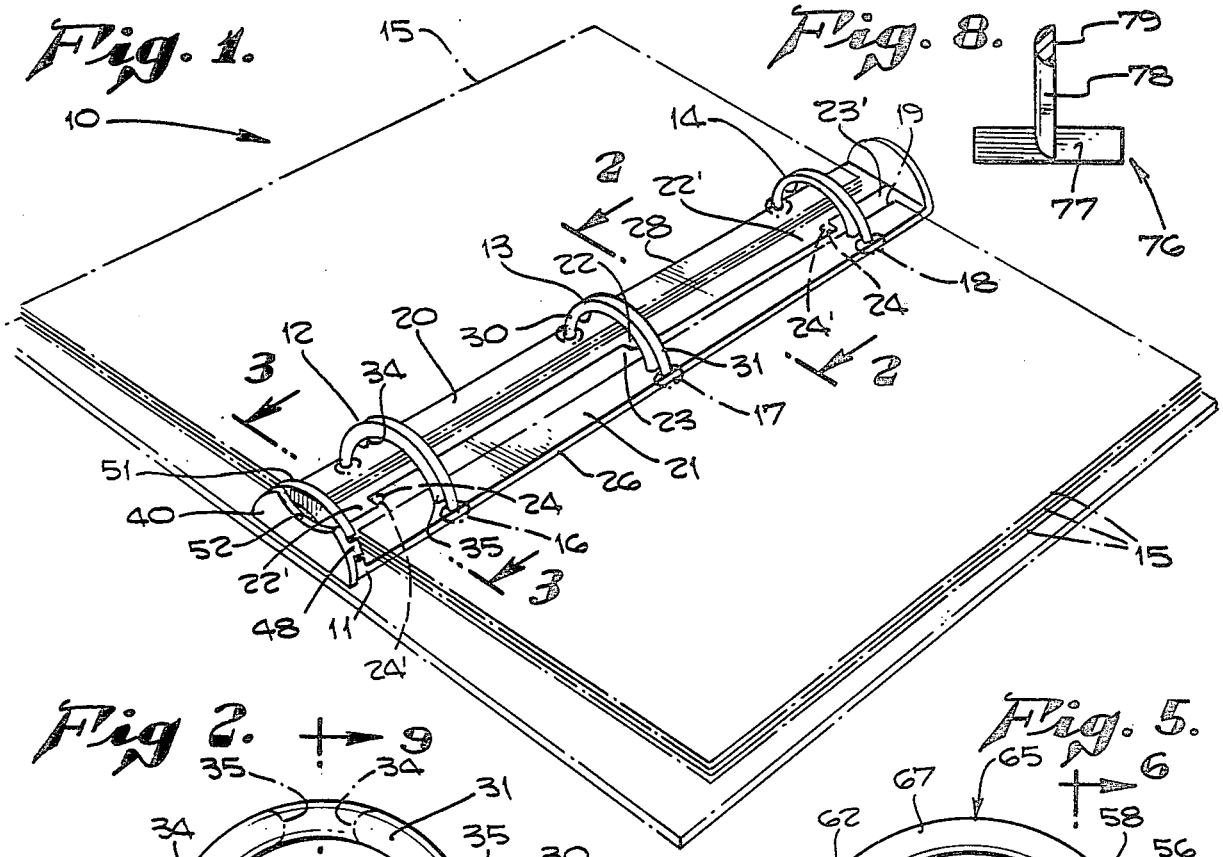
Fig. 8.
Fig 2.
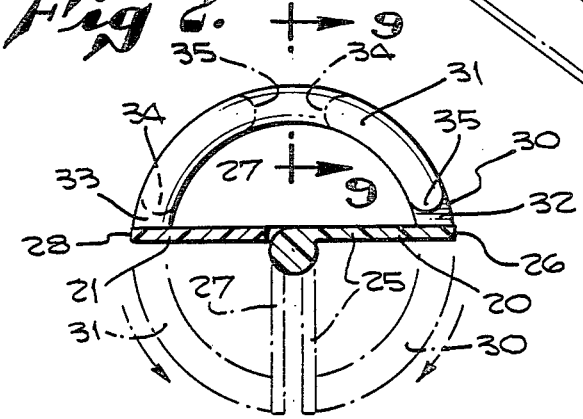
Fig. 5.
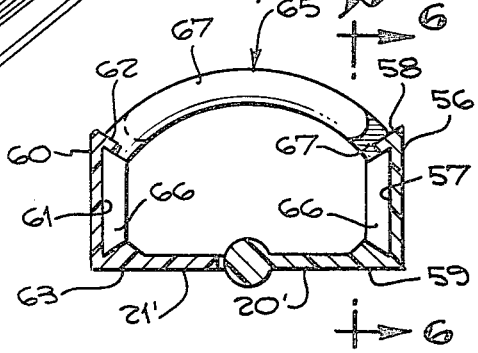
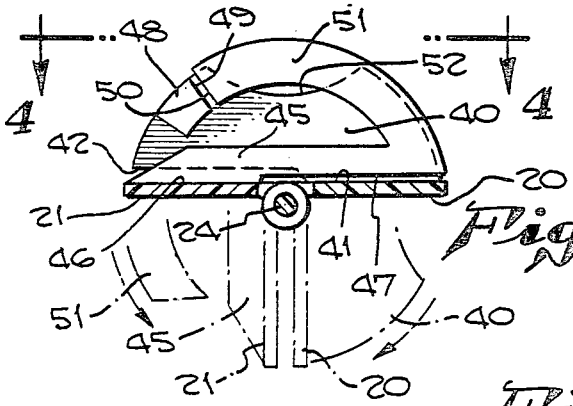
Fig. 6.
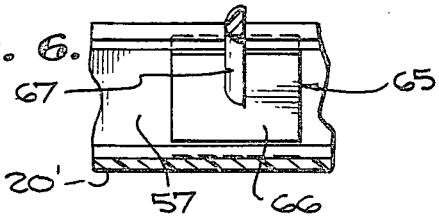
Fig. 3.
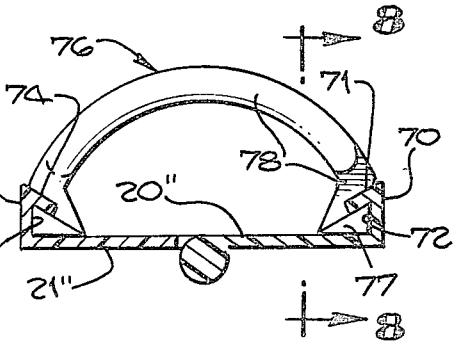
Fig. 7.
Fig. 4.
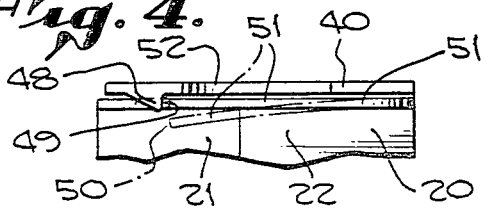
Fig. 9.
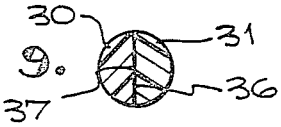

LOOSE-LEAF BINDER

Among the more generally accepted types of loose-leaf binders currently available are ring binders customarily employing three separable ring assemblies spaced at fixed locations on a back member, with front and back covers flexibly attached to opposite side edges of the back member. In such binders the ring assemblies usually consist of complementary arcuate halves of the binder assembly, the fixed ends of which are anchored in some fashion to the back member. The back member is provided with a spring action such that the opposite complementary halves of the spring assemblies are resiliently held together when the pages are in place, but can be separated one from another with the spring action holding them open when pages are to be removed and replaced.

The most common loose-leaf binders are two- and three-ring binders. There are, of course, binders using multiple rings, far in excess of three, for holding sheets of paper which are provided with a corresponding number of holes. Here also, for the most part, the rings are complementary substantially arcuate fingers anchored in a spring-like arrangement to the back member so that the rings can be opened and closed. At times such rings can be separated merely by pulling on opposite sides of the rings. On other occasions some appropriate pressure element may be provided at one or both ends of the back member.

Where attempts have been made to substitute plastic rings for metal rings having complementary halves, such rings, often spiral and continuous, are threaded through a multiple number of appropriate holes at the edges of the sheets to be bound. Such spiral binders are customarily assembled by machine rather than by hand.

On some occasions flexible plastic fingers have been provided in parallel relationship. Many of such structures provide rings which extend from one side only and are extra-long so that after passing through the holes of all of the sheets which are to be retained, free ends of the rings extend in a reverse direction into or around the back member. The flexible character of such plastic rings make it necessary to use a great many rings to hold the sheets in place and rings are poorly suited to retention of the sheets by no more than two or three rings. As a consequence, though manually applicable to sheets with appropriate perforations, the operation of removing and replacing sheets is somewhat arduous and time-consuming.

Whether the rings employed are the metal rings which have complementary halves spring-pressed together or the plastic variety, little or no attempt has been made to have the ring spacing variable to suit varied hole spacing for sheets of different lengths or to make possible the use of less expensive plastic rings adjustable as to spacing for holes of corresponding spacing.

It is, therefore, among the objects of the invention to provide a new and improved loose-leaf binder which can be constructed in a practical fashion of relatively inexpensive material and which at the same time acts in a somewhat conventional fashion to hold sheets which may be perforated with holes at no more than two or three locations.

Another object of the invention is to provide a new and improved loose-leaf binder for sheets which are provided with a plurality of holes adjacent one edge where the ring assemblies can be very readily separated and replaced by a simple but effective interlock in a structure wherein mounting for the ring assemblies is substantially homogeneous.

Still another object of the invention is to provide a new and improved loose-leaf binder for sheets provided with holes adjacent one edge wherein the ring assemblies which extend through the holes can be adjusted as to spacing along the back member whenever there should be occasion to employ sheets with holes differently spaced or perhaps sheets of different lengths where the holes might need to be varied as to spacing.

Still another object of the invention is to provide a new and improved loose-leaf binder for holding sheets with a plurality of holes adjacent one edge wherein the ring assemblies, which may be constructed of synthetic plastic resin for example, consist of opposite halves which substantially overlie each other throughout the entire span between opposite edges of the back member whereby to reinforce and strengthen each other when in assembled relationship.

Still further among the objects of the invention is to provide a loose-leaf binder for sheets having holes adjacent one edge wherein the ring assemblies consist of individual, separable and adjustable complementary elements of interchangeable character such that elements of any desired number and spacing can be adjustably mounted on opposite sides of the back member so that elements on opposite sides can reinforce each other for ruggedness or alternate with each other to provide a multiple gripping engagement with sheets having a multiple number of holes, thereby to effectively secure sheets which may be too fragile for use with binders having relatively few rings.

With these and other objects in view, the invention consists of the construction, arrangement and combination of the various parts of the device serving as an example only of one or more embodiments of the invention whereby the objects contemplated are attained as hereinafter disclosed in the specification and drawing, and pointed out in the appended claims.

FIG. 1 is a perspective substantially plan view of one form of a ring binder in assembled condition with various pages of sheet material.

FIG. 2 is a fragmentary cross-sectional view along the line 2—2 of FIG. 1.

FIG. 3 is a fragmentary cross-sectional view along the line 3—3 of FIG. 1.

FIG. 4 is a fragmentary plan view along the line 4—4 of FIG. 3.

FIG. 5 is a fragmentary cross-sectional view similar to FIG. 2 showing a second form of the invention.

FIG. 6 is a fragmentary sectional view along the line 6—6 of FIG. 5.

FIG. 7 is a fragmentary cross-sectional view similar to FIGS. 2 and 5 showing still another form of the invention.

FIG. 8 is a fragmentary sectional view of one of the ring elements of FIG. 7 struck along the line 8—8 of FIG. 7.

FIG. 9 is a cross-sectional view along the line 9—9 of FIG. 2.

Figure 10:
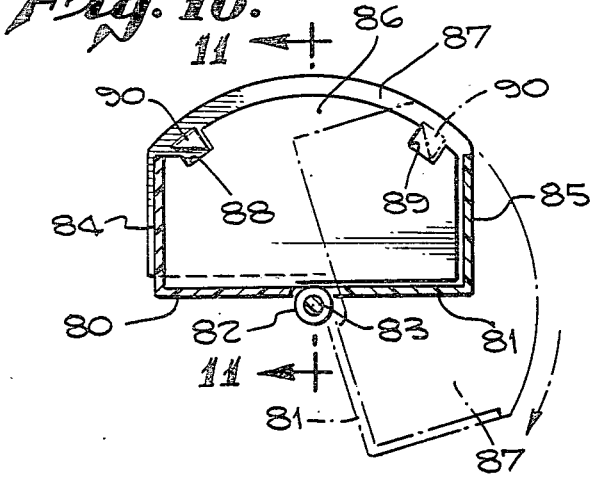
FIG. 10 is a cross-sectional view similar to FIG. 2 showing another form of the invention.

In one of the embodiments of the invention chosen for the purpose of illustration, there is shown what is commonly identified as a loose-leaf binder 10 consisting in the main of a back member 11 on which are mounted separable ring assemblies 12, 13 and 14 for the purpose of holding a multiplicity of sheets 15, usually paper, provided with holes 16, 17 and 18 adjacent an inner edge 19. Such binders are customarily provided with front and back covers which, in the interest of simplicity in the present disclosure, have been omitted.

In a particularly simplified arrangement, the back member 11 is made up of a pair of separate parallel composite hinge leaves 20 and 21, each of which extends the full length of the respective sheets 15. These hinge leaves are identical and interchangeable. Knuckles 22 and 22' of the hinge leaf 20 alternate with knuckles 23 and 23' of the hinge leaf 21. A hinge pivot plug 24 extends from an inside end of the knuckle 22' into an appropriate bore 24' in the knuckle 23. Similarly, at the opposite end a hinge pivot plug 24 extends from the inside end of the knuckle 23' into an appropriate bore 24' in the knuckle 22. To engage the plugs in the bores, the hinge leaves are merely flexed and the plugs snapped into place. In the chosen embodiment, there is an intermediate area 25 for the hinge leaf 20 residing between an outer edge 26 and the knuckles 22. For the other hinge leaf 21 there is an intermediate area 27 residing between an outer edge 28 and the knuckles 23.

The separable ring assemblies 12, 13 and 14 are substantially identical, each consisting of a pair of arcuate fingers 30 and 31. One end 32 of the arcuate finger 30 is fixed and anchored to the hinge leaf 20 adjacent the outer edge 26. The other arcuate finger 31 has one end 33 fixed and anchored to the hinge leaf 21 adjacent the outer edge 28. A free end 34 of the arcuate finger 30 extends to a position adjacent the fixed end 33, and a free end 35 of the arcuate finger 31 extends to a position lying adjacent the fixed end 32 of the arcuate finger 30. In the relationship described the two arcuate fingers 30 and 31 complement each other throughout substantially the entire arcuate distance between opposite ends. When these arcuate fingers are constructed of a synthetic plastic resin material, they may advantageously be made with each finger having a hemispherical cross-sectional shape as viewed in FIG. 9 so that respective flat faces 36 and 37 lie adjacent each other. The result is in effect a composite arcuate figure having a circular cross-sectional shape.

For interlocking the ring assemblies in assembled condition, such as is illustrated in FIGS. 1 and 2, the hinge leaf 20 is provided with a flange 40 substantially hemispherical in shape arranged in such fashion that an edge 41 equal to the radius is anchored to the hinge leaf 20 and an edge 42 overlies the hinge leaf 21 but is separated from it. Conversely, the hinge leaf 21 is provided with what amounts to a flange 45 substantially hemispherical in shape and wherein an edge 46 is anchored to the leaf hinge 21 and an edge 47 overlies but is free of the leaf hinge 20.

On the flange 40 is a projection 48 which provides a shoulder 49. An end face 50 of an arcuate leg 51 provides a complementary shoulder which is adapted to engage with the shoulder 49. The abutting relationship of the shoulders is also shown by the solid line positions of the parts in FIG. 4. These are the positions of parts for the loose-leaf binder as shown also in FIG. 1.

When it becomes desirable to separate the opposite parts of the ring assemblies, the shoulders 49 and 50 are disengaged by flexing the arcuate leg 51 from the solid line position of FIG. 4 to the broken line position. When this has been done, the hinge leaves 20 and 21 can be rotated arcuately downwardly as shown by the broken lines of FIG. 3 until the free ends 34 and 35 are spaced apart as shown by the broken lines in FIG. 2, in this way to permit sheets 15 to be removed and replaced. To improve accessibility to the arcuate leg 51, there is a notch or recess 52 provided at the crest of the flange 40.

After a suitable new arrangement has been made of the sheets 15, the ring assemblies can be closed by returning the hinge leaves 20 and 21 from the broken line position of FIG. 2 to the solid line position. When this has occurred, the arcuate leg 15 will flex back into its solid line position of FIG. 4 with the shoulders again in abutting engagement.

In the form of invention of FIGS. 5 and 6, a hinge leaf 20' is provided with a side plate 56 at its outside edge providing a track 57 extending from end to end of the leaf hinge. Opposite tabs 58 and 59 enclose the track 57. Similarly, on the opposite side there is a side plate 60 at the outside edge of the leaf hinge 21' forming a track 61 by means of the tabs 62 and 63.

Cooperating with the tracks 57 and 61 is a series of ring fixtures 65 each consisting of a shoe 66 and an arcuate finger 67 having its fixed end anchored preferably to the mid-portion of the shoe 66. Opposite edges of the shoe 66 have wedge-like shapes so as to be slidably retained beneath the respective tabs 58 and 59. The same ring fixture 65 with its shoe 66 and arcuate finger 67 is adapted to be slidably received in the track 61 of the opposite leaf hinge 21'. Clearly from the description given, the ring fixtures may be matched opposite each other inasmuch as they are complementary to each other when reversed side-for-side, thus to provide a composite retaining ring for the sheets. Since the ring fixtures are slidable in the tracks, each pair of matching fixtures can be shifted along the leaf springs so as to accommodate virtually any variety of spacing of the holes 16, 17, 18, etc., of the sheets 15.

A further modification of adjustable ring fixtures is shown in FIGS. 7 and 8. In the last mentioned embodiment, a hinge leaf 20'' is provided at its outer edge with a narrow rim plate 70 which has at its free edge a tab 71 providing an undercut for a track 72. Similarly, on the opposite side of the leaf hinge 21'' there is a rim plate 73 with tab 74 providing an undercut for a track 75.

Here again the ring assembly is made up of a pair of matching complementary ring fixtures 76 consisting of a shoe 77 and an arcuate finger 78. The shoe 77 has a cross-sectional shape as shown in FIG. 7 adapted to slidably engage the track 72 on the one side or the track 75 on the other side. In each instance the arcuate finger has its fixed end integral with and thereby anchored to the respective shoe of the arcuate fingers, or as shown in FIG. 8, hemispherical in cross-sectional shape so that respective flat sides 79 may be brought in face-to-face relationship to double the strength of the arcuate finger portion. Here again the ring assemblies can be shifted in position along the tracks so as to accommodate holes variously spaced as well as to accommodate as many holes as might be employed.

Figure 11:
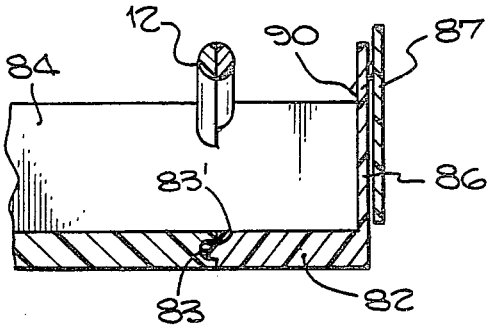
FIG. 11 is a fragmentary sectional view on the line 11—11 of FIG. 10.

The flange and shoulder arrangement made reference to in connection with FIGS. 2, 3 and 4, can be achieved by other related means, as for example the form of invention of FIGS. 10 and 11. Here, by way of example, hinge leaves 80 and 81 have the same parallel relationship previously made reference to in connection with the hinge leaves 20 and 21. They are also provided with suitable knuckles like the knuckle 82 pivotally interconnected by use of hinge plugs 83 lodged in bores in the same manner as described for FIGS. 1, 2 and 3. In this example, the hinge leaf 80 has a side wall 84 and the hinge leaf 81 a side wall 85. The arrangement of ring assemblies 12, 13 and 14 of FIG. 1 are, in FIGS. 10 through 17, attached in the same fashion to the tops of the side walls 84 and 85. The ring assembly 12 is shown in fragmented form in FIGS. 11 and 12, but omitted in FIG. 10 and FIGS. 13 through 17.

In the example of FIG. 10, there is a flange 86 extending from the hinge leaf 80. A complementary flange 87 extends from the hinge leaf 81. On this occasion notches 88 and 89 are formed in the flange 86, the notches being spaced arcuately one from another by a distance slightly less than the distance between the side walls 84 and 85. Cooperating with the notch 88 is a bent tab 90, the tab providing a shoulder in cooperation with one side of the notch 88 serving as a counteracting shoulder. When the binder is opened, the tab 90 is adapted to engage the notch 89 thereby to provide a pair of interlocking shoulders in open position. These shoulders are disengaged in the same manner previously described, namely by flexing one of the flanges with respect to the other.

Figure 12:
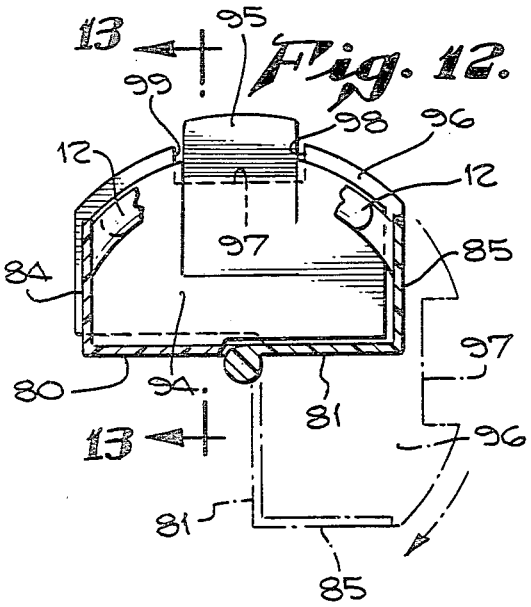
FIG. 12 is a cross-sectional view of another form of the invention.
Figure 13:
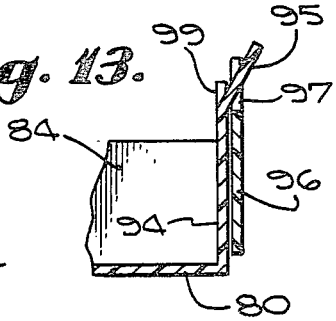
FIG. 13 is a fragmentary sectional view on the line 13—13 of FIG. 12.

In the form of invention of FIGS. 12 and 13, a flange 94 extending from the hinge leaf 80 is provided with a tab 95 bent outwardly with respect to the plane of the flange 94 as shown in FIG. 13. A second flange 96, extending from the hinge leaf 81, has a transversely extending cut-out portion 97 forming oppositely facing shoulders 98 and 99. These shoulders are designed to cooperate with opposite side edges of the tab 95 also serving as interlocking shoulders. Here again, to disengage the shoulders, the tab 95 may be flexed out of its position within the cut-out portion 97.

Figure 15:
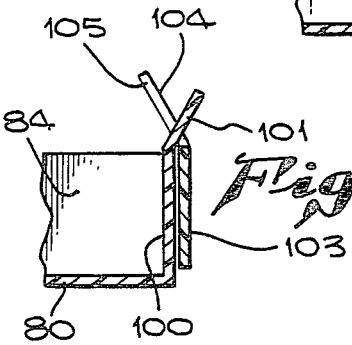
FIG. 15 is a fragmentary sectional view on the line 15—15 of FIG. 14.
Figure 14:
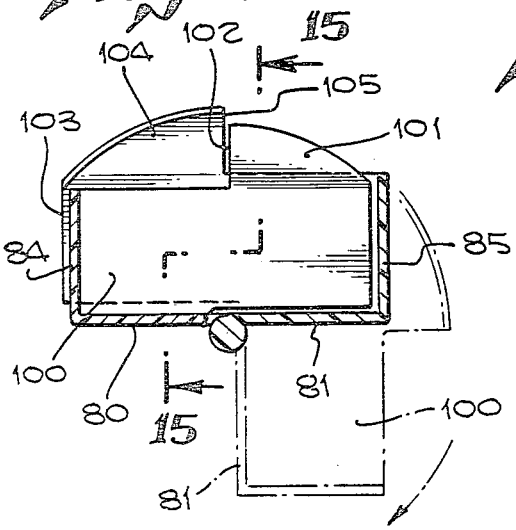
FIG. 14 is a cross-sectional view of still another form of the invention.

In another arrangement shown in FIGS. 14 and 15, a flange 100 is an extension of the hinge leaf 80 and extends to a position overlying the hinge leaf 81. For one-half of its length at the upper edge is an extension 101, at the left edge of which is a shoulder 102.

Somewhat similarly, there is a flange 103 extending from the hinge leaf 81 to a position overlying the hinge leaf 80. An extension 104 provides a shoulder 105 which cooperates with the shoulder 102. These shoulders may be disengaged by flexing either or both of the extensions 101 and 104.

Figure 17:
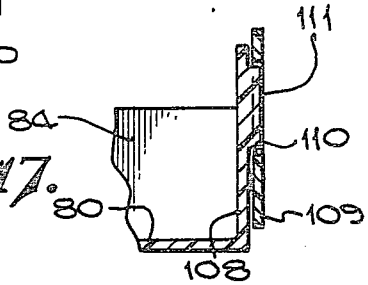
FIG. 17 is a fragmentary cross-sectional view on the line 17—17 of FIG. 16.
Figure 16:
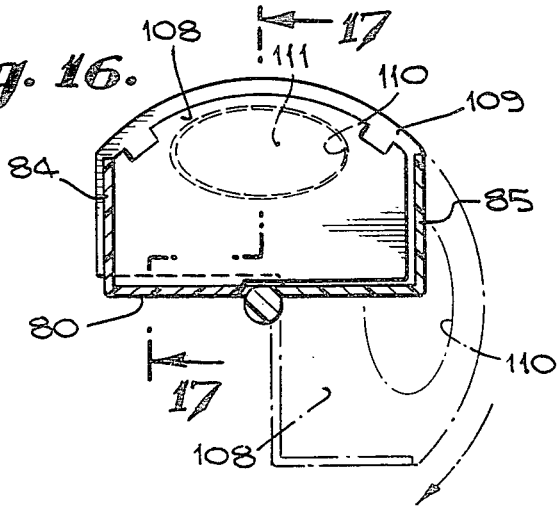
FIG. 16 is a cross-sectional view of yet another form of the invention.

Yet again, for the form of the invention of FIGS. 16 and 17, the hinge leaf 80 supports a flange 108 which extends toward the right as viewed in FIG. 16 to a position overlying the hinge leaf 81. On the hinge leaf 81 is a flange 109 which extends to a position overlying the hinge leaf 80. There is an opening 110 in the flange 109 which, just by way of example in FIGS. 16 and 17, is elliptical. Cooperating with the opening 110 is an elliptical projection 111 on the outer face of the flange 108. The perimetrical edges respectively of the elliptical projection 111 and the elliptical opening 110 serve as interlocking shoulders for the two flanges 108 and 109. Here, as in the forms of invention previously described, disengagement is accomplished by flexing one of the flanges 108 or 109 with respect to the other a distance sufficient to disengage the elliptical projection from the elliptical opening.

While particular embodiments of the present invention have been shown and described, it will be obvious to those skilled in the state of the art that changes and modifications may be made without departing from the invention in its broader aspects, and therefore, the aims of its appended claims is to cover all such changes and modifications as fall within the true spirit and scope of this invention.

Having described the invention, what is claimed as new in support of Letters Patent is as follows:

1. A loose-leaf binder for sheets which are provided with a plurality of holes adjacent one edge, said binder comprising a back member on which is mounted a plurality of separable ring assemblies in spaced relationship for retention of said sheets, said back member comprising a pair of separate parallel composite hinge leaves with a pivotal connection interconnecting said hinge leaves at adjacent edges, and a releasable interlock between said hinge leaves comprising a flange on each of the leaves, said flanges being of relatively thin flat sheet material and of substantially uniform thickness, said flanges being laterally yieldable and having an overlying relationship with a shoulder on one flange and a shoulder on the other flange being in abutting engagement when the hinge leaves and ring assemblies are interlocked, at least one of said flanges having a lateral resilient displacement relative to the other whereby to disengage said shoulders and enable movement of said flanges in planes parallel to each other to effect separation of said ring assemblies for removal and replacement of said sheets.

2. A loose-leaf binder as in claim 1 wherein the shoulder on said one flange comprises an end edge of the flange and the shoulder on the other flange is a lateral projection.

3. A loose-leaf binder as in claim 1 wherein there is a cut-out section on one of said flanges which exposes an adjacent corresponding section of the other flange for manipulation of said other flange during disengagement of said shoulders.

4. A loose-leaf binder as in claim 1 wherein one of said flanges has a transversely extending cut-out portion forming oppositely facing shoulders and the other flange has a tab of shape and size complementary with respect to the cut-out portion forming shoulders, the tab having a releasably deflected position within said cut-out portion when interlocked.

5. A loose-leaf binder as in claim 1 wherein one of said flanges has a cut-out portion on one side and a tab on the opposite side forming a shoulder, the other flange having a tab on said one side and a cut-out portion on said other side forming a complementary shoulder, the respective tabs having bent positions releasably received in the respective cut-out portions when interlocked.

6. A loose-leaf binder as in claim 1 wherein there is an opening in one of said flanges having a linearly continuous perimeter and a relatively flat projection on the other flange having a perimetrical shape complementary to the shape of said opening and adapted to be releasably received in said opening, thereby to provide shoulders for releasable interlocked engagement.

7. A loose-leaf binder as in claim 1 wherein each said ring assembly comprises an arcuate finger having one end anchored to one of said hinge leaves and the other end positioned adjacent to but free of the other of said hinge leaves.

8. A loose-leaf binder as in claim 7 wherein each said ring assembly includes a second arcuate finger in lateral engagement with the first arcuate finger and having one end anchored to the other of said hinge leaves with the other end of said second arcuate finger positioned adjacent to but free of the opposite hinge leaf.

9. A loose-leaf binder as in claim 8 wherein one finger of each pair has a hemispherical cross-sectional shape and the other finger of said pair has a complementary hemispherical cross-sectional shape.

10. A loose-leaf binder as in claim 1 wherein there is a longitudinally extending track on one of said hinge leaves, said separable ring assemblies each comprising a shoe adjustably retained by said track with an arcuate finger having a fixed end anchored to said shoe and a free end lying adjacent to but free of the hinge leaf on the opposite side.

11. A loose-leaf binder as in claim 10 wherein there is a track on each of said hinge leaves, each said separable ring assembly comprising a pair of complementary arcuate fingers, the fixed end of one of said arcuate fingers being anchored to a shoe adjustably retained by one of said tracks and the fixed end of the other complementary arcuate finger being anchored to a second shoe adjustably retained by the other of said tracks.

12. A loose-leaf binder as in claim 11 wherein each track comprises an intermediate area positioned at an angle to the plane of the corresponding hinge leaf and retention edges in spaced parallel relationship adjacent opposite outside edges of the intermediate area adapted to slidably interlock with corresponding side edges of the respective shoes.

13. A loose-leaf binder as in claim 1 wherein each of said flanges has a first section of one edge in anchored engagement with one of said hinge leaves and a second section of said edge overlying but separated from the adjacent hinge leaf which is interlocked with said one of said hinge leaves.

* * * * *